US007891334B2

(12) United States Patent
O'Leary

(10) Patent No.: US 7,891,334 B2
(45) Date of Patent: Feb. 22, 2011

(54) ENGINE WITH VARIABLE LENGTH CONNECTING ROD

(76) Inventor: Paul W. O'Leary, 4609 12th St. NE., Great Falls, MT (US) 59404

( * ) Notice: Subject to any disclaimer, the term of this patent is extended or adjusted under 35 U.S.C. 154(b) by 439 days.

(21) Appl. No.: 12/174,806

(22) Filed: Jul. 17, 2008

(65) Prior Publication Data

US 2010/0012094 A1 Jan. 21, 2010

(51) Int. Cl.
*F02B 75/32* (2006.01)

(52) U.S. Cl. ..... 123/197.4; 74/579 E

(58) Field of Classification Search ... 123/197.1–197.4; 74/579 R, 579 E
See application file for complete search history.

(56) References Cited

U.S. PATENT DOCUMENTS

| | | | | |
|---|---|---|---|---|
| 1,553,009 | A | 7/1923 | Stuke | |
| 2,287,472 | A | 3/1941 | Eby | |
| 4,152,955 | A * | 5/1979 | McWhorter | 74/602 |
| 4,319,498 | A | 3/1982 | McWhorter | |
| 4,406,256 | A | 9/1983 | Akkerman | |
| 4,538,557 | A | 9/1985 | Kleiner et al. | |
| 4,567,866 | A | 2/1986 | Schubert | |
| 4,974,554 | A | 12/1990 | Emery | |
| 5,060,603 | A | 10/1991 | Williams | |
| 5,146,879 | A | 9/1992 | Kume et al. | |
| 5,158,047 | A | 10/1992 | Schaal et al. | |
| 5,245,962 | A | 9/1993 | Routery | |
| 5,724,935 | A | 3/1998 | Routery | |
| 5,791,302 | A | 8/1998 | Ma | |
| 6,125,802 | A | 10/2000 | Pen | |
| 6,202,622 | B1 | 3/2001 | Raquiza, Jr. | |
| 6,390,035 | B2 | 5/2002 | Moteki et al. | |
| 6,394,047 | B1 | 5/2002 | Rao et al. | |
| 6,394,048 | B1 | 5/2002 | Styron | |
| 6,408,804 | B1 | 6/2002 | Rao et al. | |
| 6,453,869 | B1 | 9/2002 | Moore | |
| 6,505,582 | B2 | 1/2003 | Moteki et al. | |
| 6,546,900 | B2 | 4/2003 | Arai et al. | |
| 6,561,142 | B2 | 5/2003 | Moteki et al. | |
| 6,612,288 | B2 | 9/2003 | Cullen | |
| 6,622,670 | B2 | 9/2003 | Hiyoshi et al. | |
| 6,665,605 | B2 | 12/2003 | Boyer et al. | |
| 6,668,768 | B2 | 12/2003 | Styron et al. | |
| 6,679,203 | B2 | 1/2004 | Styron | |
| 6,705,255 | B2 | 3/2004 | Papaioannou et al. | |
| 6,779,495 | B2 | 8/2004 | Yamada et al. | |
| 6,779,510 | B2 | 8/2004 | Russell | |
| 6,820,577 | B2 | 11/2004 | Yamada | |

(Continued)

*Primary Examiner*—Noah Kamen
(74) *Attorney, Agent, or Firm*—Antoinette M. Tease

(57) ABSTRACT

A four-cycle internal combustion engine comprising a variable length connecting rod, two crank gears, and two drive gears; the first end of the connecting rod is connected to a piston; the second end of the connecting rod is connected to a yoke assembly comprising two arms, a first connecting shaft, and two second connecting shafts; the first connecting shaft connects the second end of the connecting rod to each of the yoke arms; the second end of the connecting rod and the yoke arms rotate freely about the first connecting shaft; each crank gear comprises an off-center hole; the second connecting shafts connect the yoke arms to the off-center hole of each crank gear; the yoke arms and the crank gear rotate freely about the second connecting shaft; and each crank gear is driven by a drive gear.

5 Claims, 10 Drawing Sheets

U.S. PATENT DOCUMENTS

| | | | | |
|---|---|---|---|---|
| 6,857,401 | B1 | 2/2005 | Styron | |
| 7,007,638 | B2 | 3/2006 | Yamada | |
| 7,021,270 | B1 | 4/2006 | Stanczyk | |
| 7,028,647 | B2 | 4/2006 | Styron | |
| 7,185,557 | B2 | 3/2007 | Venettozzi | |
| 7,185,615 | B2 | 3/2007 | Sato et al. | |
| 7,263,965 | B2 | 9/2007 | Bloomquist | |
| 7,293,542 | B2 | 11/2007 | Ozdamar | |
| 7,556,014 | B2 * | 7/2009 | Mason | 123/197.4 |
| 2002/0083908 | A1 | 7/2002 | Moore, II | |
| 2003/0075125 | A1 | 4/2003 | Kreuter | |
| 2003/0089320 | A1 | 5/2003 | Styron et al. | |
| 2004/0011307 | A1 | 1/2004 | Sato et al. | |
| 2004/0134452 | A1 | 7/2004 | Yamada | |
| 2005/0061270 | A1 | 3/2005 | Yamada | |
| 2005/0150471 | A1 | 7/2005 | Styron | |
| 2006/0053964 | A1 | 3/2006 | Venettozzi | |
| 2007/0137422 | A1 | 6/2007 | Betzmeir | |
| 2007/0137606 | A1 | 6/2007 | Takahashi et al. | |
| 2007/0137608 | A1 | 6/2007 | Mizuno et al. | |
| 2007/0150164 | A1 | 6/2007 | Froloff et al. | |
| 2007/0169739 | A1 | 7/2007 | Meyer et al. | |
| 2007/0204829 | A1 | 9/2007 | Takahashi et al. | |
| 2007/0209630 | A1 | 9/2007 | Hiraya et al. | |
| 2007/0215132 | A1 | 9/2007 | Kobayashi et al. | |
| 2007/0295122 | A1 | 12/2007 | Garavello | |

* cited by examiner

ENGINE WITH VARIABLE LENGTH CONNECTING ROD

BACKGROUND OF THE INVENTION

1. Field of the Invention

The present invention relates generally to four-cycle internal combustion engines, and more specifically, to an internal combustion engine with a variable length connecting rod that increases the length of the power and exhaust strokes relative to the intake and compression strokes.

2. Description of the Related Art

A four-cycle internal combustion engine has four strokes: the intake stroke, during which the intake valve opens and the piston travels downward away from the cylinder head, thereby allowing the fuel/air mixture to enter the cylinder; the compression stroke, during which the intake valve closes and the piston travels back toward the cylinder head, thereby compressing the fuel/air mixture that entered the cylinder during the intake stroke; the power stroke, during which the fuel/air mixture in the cylinder is ignited, thereby forming high-pressure gases that force the piston down the cylinder; and the exhaust stroke, during which the exhaust valve opens and the piston moves back toward the cylinder head, thereby causing the high-pressure gases that were formed during the power stroke to be emitted as exhaust. The power generated during the power stroke is what drives the engine.

In current four-cycle internal combustion engines, the distance traveled by the piston during the intake and compression cycles is the same as the distance traveled by the piston during the power and exhaust cycles. In other words, the volume of all four cycles is equal. The distance traveled is sometimes referred to in terms of a ratio, in this case, the ratio of the distance of the piston from the cylinder head when it is at the end of the intake (or power) stroke and the beginning of the compression (or exhaust) stroke to the distance of the piston to the cylinder head at the beginning of the intake (or power) stroke and the end of the compression (or exhaust) stroke. This ratio is referred to as the "compression ratio," which is typically 8:1 for a four-cycle internal combustion engine that uses gasoline.

The theoretical efficiency of this type of engine is a function of the compression ratio. An 8:1 compression ratio corresponds to a thermodynamic efficiency rate of approximately 56%. If the engine cycle is altered so that the volume of the power and exhaust cycles is greater than the volume of the intake and compression cycles, then the thermodynamic efficiency rate of the engine increases. For example, the theoretical efficiency of an engine with an 8:1 compression ratio and a 16:1 power ratio is 67%, which represents a 20% increase in efficiency over an engine in which the volume of the intake/compression strokes is equal to the volume of the power/exhaust strokes. Assuming this increase in thermodynamic efficiency translates into a corresponding increase in mechanical efficiency, this would result in an increase in gas mileage from 25 miles per gallon to 30 miles per gallon for the average vehicle.

Accordingly, it is an object of the present invention to provide a design for four-cycle engines (four-cylinder or six-cylinder) that will increase the volume of the power and exhaust strokes relative to the intake and compression strokes and that can be used with any available fuel, including gasoline, diesel fuel and ethanol. It is a further object of the present invention to provide a redesigned engine that requires no changes to existing valves or timing. Yet another object of the present invention is to decrease the temperature and pressure of the exhaust gases, thereby increasing fuel efficiency by capturing more of the energy from the combustion of the fuel.

BRIEF SUMMARY OF THE INVENTION

The present invention is a four-cycle internal combustion engine comprising a variable length connecting rod, two crank gears, and two drive gears; wherein the connecting rod comprises a first end and a second end; wherein the first end of the connecting rod is connected to a piston; wherein the piston is located inside of a cylinder; wherein the second end of the connecting rod is connected to a yoke assembly; wherein the yoke assembly comprises two arms, a first connecting shaft, and two second connecting shafts; wherein the second end of the connecting rod comprises an aperture through which the first connecting shaft extends; wherein the first connecting shaft connects the second end of the connecting rod to each of the yoke arms; wherein the second end of the connecting rod and the yoke arms rotate freely about the first connecting shaft; wherein each crank gear comprises an off-center hole; wherein the second connecting shafts connect the yoke arms to the off-center hole of each crank gear; wherein the yoke arms and the crank gear rotate freely about the second connecting shaft; wherein each crank gear is driven by a drive gear; wherein the piston travels downward in the cylinder during an intake stroke and a power stroke; and wherein the piston travels farther downward in the cylinder during the power stroke than it does during the intake stroke.

In a preferred embodiment, the engine undergoes an intake stroke, a compression stroke, a power stroke and an exhaust stroke; the piston travels the same distance during the intake stroke as it does during the compression stroke; the piston travels the same distance during the power stroke as it does during the exhaust stroke; the engine releases exhaust gas during the exhaust stroke; the exhaust gas has a temperature and a pressure; a traditional four-cycle internal combustion engine generates exhaust gas with a temperature and pressure; and the temperature and pressure of the exhaust gas generated by the present invention are lower than the temperature and pressure of the exhaust gas in a traditional four-cycle internal combustion engine.

In a preferred embodiment, each crank gear has a center; each off-center hole in each crank gear has a center; the first and second connecting shafts each has a center; and during the intake stroke, the piston travels a distance equal to two times the distance from the center of the crank gear to the center of the off-center hole in the crank gear minus two times the distance from the center of the first connecting shaft to the center of the second connecting shafts.

In a preferred embodiment, each crank gear has a center; each off-center hole in each crank gear has a center; and during the power stroke, the piston travels a distance equal to two times the distance from the center of the crank gear to the center of the off-center hole in the crank gear.

In a preferred embodiment, each crank gear has a center; each off-center hole in each crank gear has a center; the first and second connecting shafts each has a center; $R_c$ is the distance between the center of the crank gear and the center of the off-center hole; $R_y$ is the distance between the center of the first connecting shaft and the center of the second connecting shafts; the engine undergoes an intake stroke, a compression stroke, a power stroke and an exhaust stroke, and each stroke has a beginning and an end; there is headspace in the cylinder above the piston at the end of the intake, compression, power and exhaust strokes; $H_o$ is the amount of headspace above the piston at the end of the compression and exhaust strokes; $H_i$ is the amount of headspace above the piston at the end of the intake stroke; $H_p$ is the amount of headspace above the piston at the end of the power stroke; the intake stroke and power stroke each has a length; the length of the intake stroke is equal to $H_i-H_o$ or $(2\times R_c)-(2\times R_y)$; the length of the power stroke is equal to $H_p-H_o$ or $(2\times R_c)$; and $R_y$ is less than $R_c$.

REFERENCE NUMBERS

Figure 2:
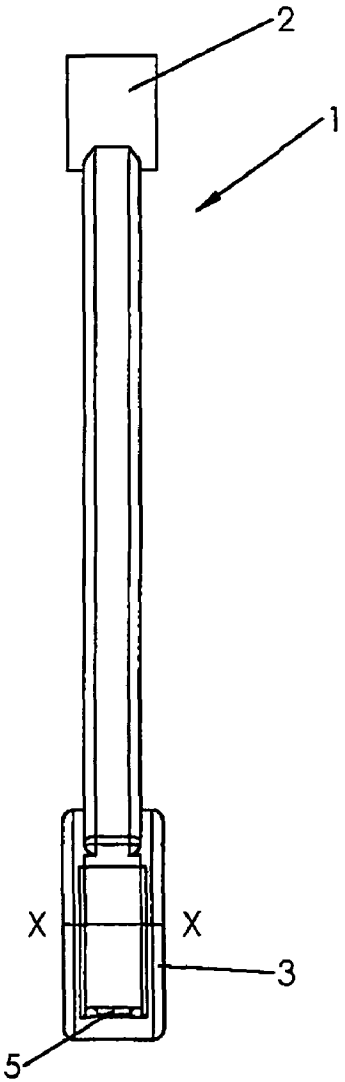
FIG. 2 is a side view of the connecting rod of the present invention.

1 Connecting rod
2 First end (of connecting rod)
3 Second end (of connecting rod)
4 Aperture (in second end of connecting rod)
5 Screw
6 Yoke assembly
7 Arm (of yoke assembly)
10 First connecting shaft
11 Second connecting shaft
12 Washer
13 Crank gear
15 Aperture/off-center hole (in crank gear)
16 Third connecting shaft
17 Drive gear
18 Drive shaft
19 Piston
20 Cylinder

DETAILED DESCRIPTION OF INVENTION

Figure 1:
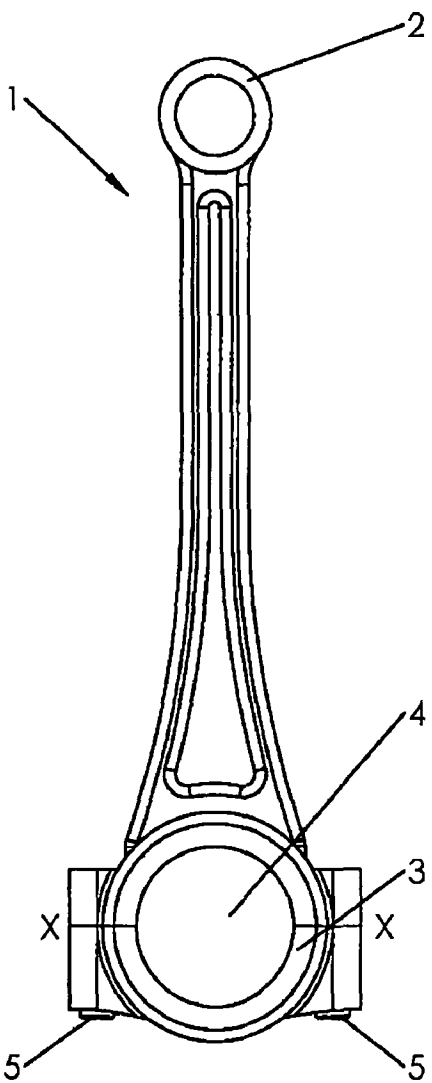
FIG. 1 is a top view of the connecting rod of the present invention.

FIG. 1 is a top view of the connecting rod of the present invention. The first end 2 of the connecting rod 1 is connected to the piston (see FIG. 7), and the second end 3 of the connecting rod 1 is connected to the yoke assembly (see FIG. 8). As described in connection with FIG. 3, the second end 3 of the connecting rod comprises an aperture 4 through which a first connecting shaft 10 (not shown) extends to connect the connecting rod 1 to each arm 7 of the yoke assembly 6. The connecting rod 1 is preferably constructed in two parts (see line "X") for ease of assembly, with screws 5 holding the two parts of the connecting rod together. A typical connecting rod design is shown in FIG. 1, but the present invention is not limited to any particular shape of the connecting rod as long as it is connected to the piston on one end and the yoke assembly on the other end. FIG. 2 is a side view of the connecting rod of the present invention.

Figure 4:
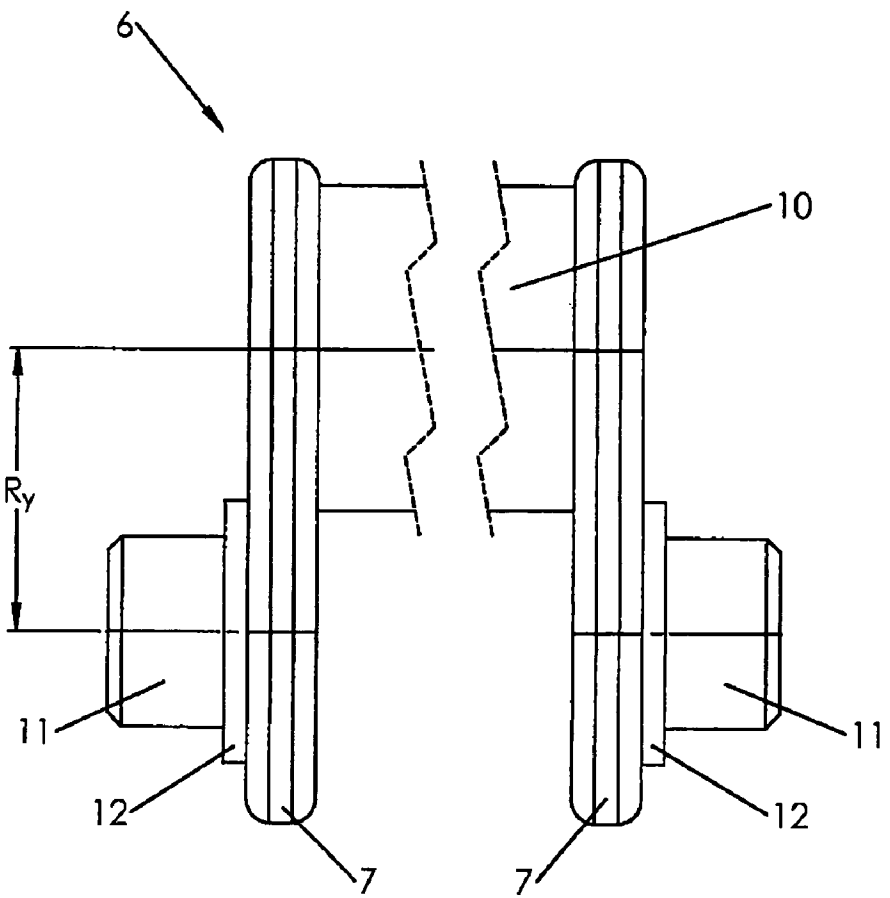
FIG. 4 is a side view of the yoke assembly of the present invention.
Figure 3:
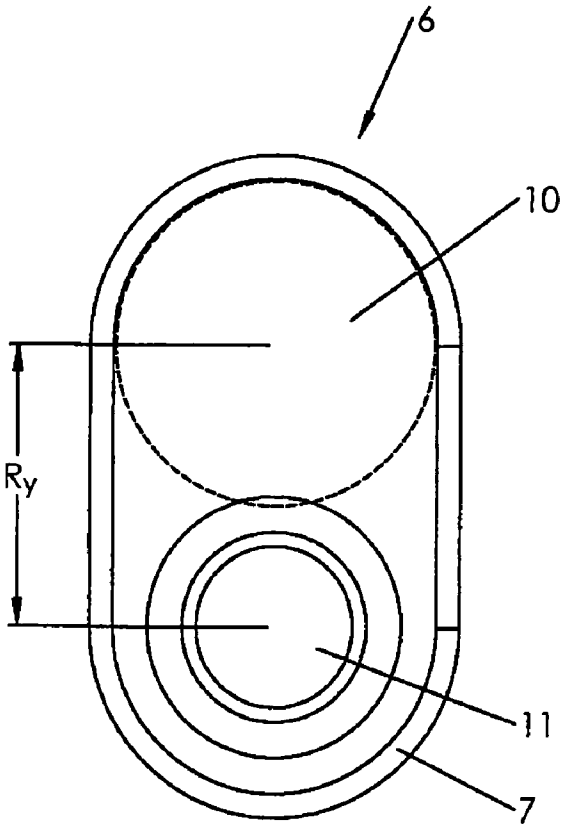
FIG. 3 is a top view of the yoke assembly of the present invention.

FIG. 3 is a top view of the yoke assembly of the present invention, and FIG. 4 is a side view of the yoke assembly of the present invention. As shown in these figures, the yoke assembly 6 comprises two arms 7, a first connecting shaft 10 and two second connecting shafts 11. The first connecting shaft 10 is attached to the yoke arm 7 as shown in FIGS. 3 and 4. The first connecting shaft 10 extends through the aperture 4 in the second end 3 of the connecting rod (see FIG. 8), thereby connecting the yoke arm 7 to the connecting rod 1. The second connecting shaft 11 connects the yoke arm 7 to the off-center hole 15 of the crank gear (see FIG. 5). Washers 12 preferably lie on the second connecting shafts 11 on the outside of each arm 7 to prevent friction between the arms 7 and the crank gears (see FIG. 8). The distance from the center of the first connecting shaft 10 to the center of the second connecting shaft 11) is designated as $R_y$ in FIGS. 3 and 4.

Figure 5:
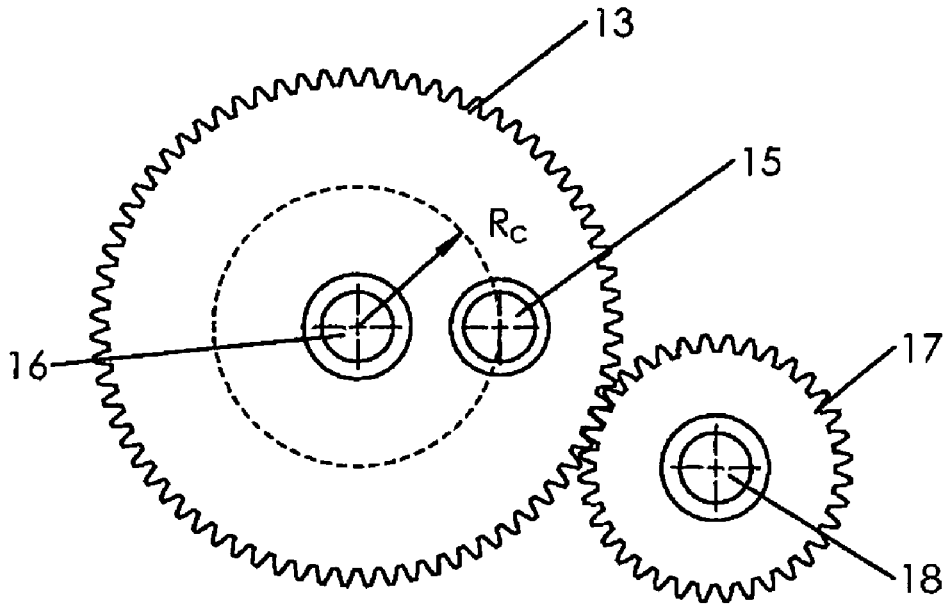
FIG. 5 is a top view of the crank and drive gears of the present invention.
Figure 6:
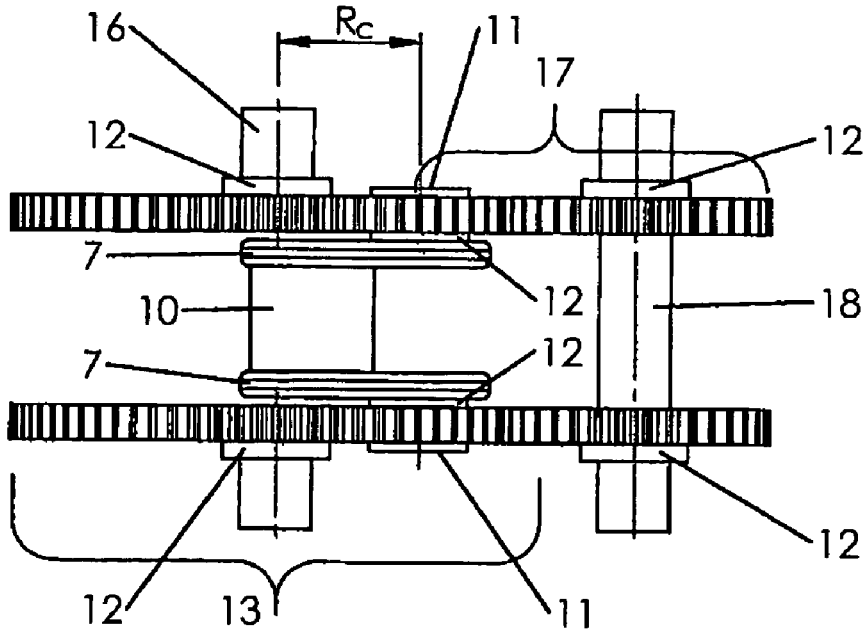
FIG. 6 is a side view of the crank and drive gears of the present invention.

FIG. 5 is a top view of the crank and drive gears of the present invention, and FIG. 6 is a side view of the crank and drive gears of the present invention. The crank gear 13 comprises an aperture or off-center hole 15 and a third connecting shaft 16. The third connecting shaft 16 extends through the center of the crank gear 13, through the crank gears of adjacent cylinders, and is attached on both ends to the engine block (not shown). In a preferred embodiment, the third connecting shaft 16 is fixedly attached to the crank gear 13 and rotates at the point at which it is attached to the engine block. In an alternate embodiment, the third connecting shaft 16 would be fixedly attached to the engine block, and the crank gears 13 would rotate around the third connecting shaft 16.

The off-center hole 15 is located between the center of the crank gear and the outside radius of the crank gear. The second connecting shaft 11 (see FIG. 6) extends through the off-center hole 15 and connects the crank gears 13 to the arms 7 of the yoke assembly 6. The distance from the center of the third connecting shaft 16 to the center of the off-center hole 15 (or the center of the second connecting shaft 11) is designated as $R_c$ in FIGS. 5 and 6.

The crank gear 13 is driven by the drive gear 17, which is connected to the engine flywheel by a drive shaft 18 that extends through the center of the drive gear 17. Washers 12 preferably lie on the drive shaft 18 on the outside of each drive gear 17 and also on the third connecting shaft 16 on the outside of each crank gear 13. The drive gear 17 also serves to maintain the crank gears 13 in proper alignment relative to the yoke assembly 6.

Figure 7:
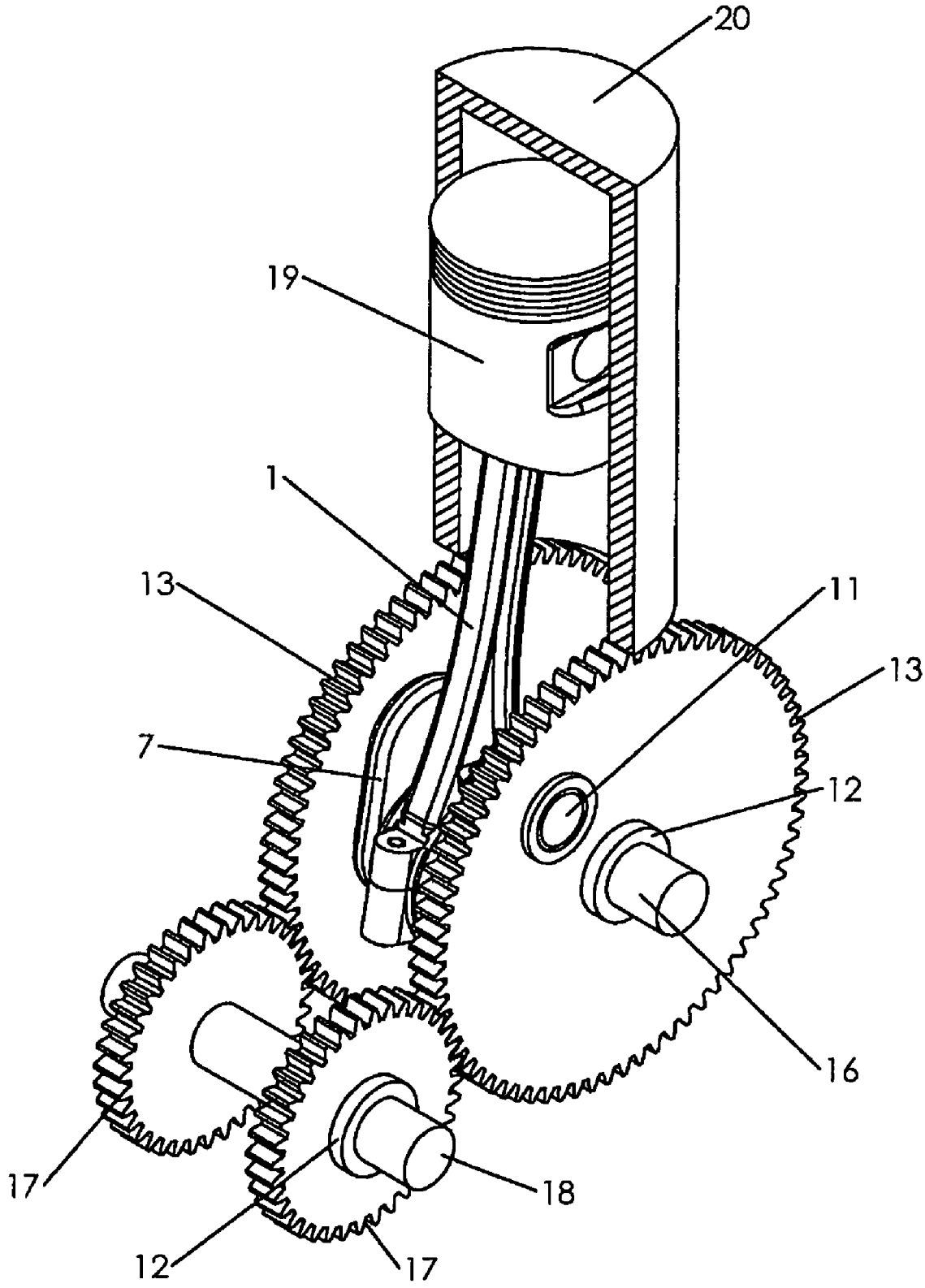
FIG. 7 is a perspective view of the present invention.

FIG. 7 is a perspective view of the present invention. This figure shows the piston 19 to which the first end 2 of the connecting rod 1 is connected and the cylinder 20 in which the piston 19 is situated. It also shows the crank gears 13, drive gears 17 and drive shaft 18. An arm 7 of the yoke assembly lies just inside each of the crank gears 13. The second connecting shaft 11, which extends through the off-center hole 15 in each crank gear 13 connects the crank gears to the arms 7 of the yoke assembly such that the arms 7 can rotate freely about the second connecting shaft 11. The first connecting shaft 10 (see FIGS. 4 and 8) allows the connecting rod and arms 7 to rotate freely about the first connecting shaft 10.

Figure 8:
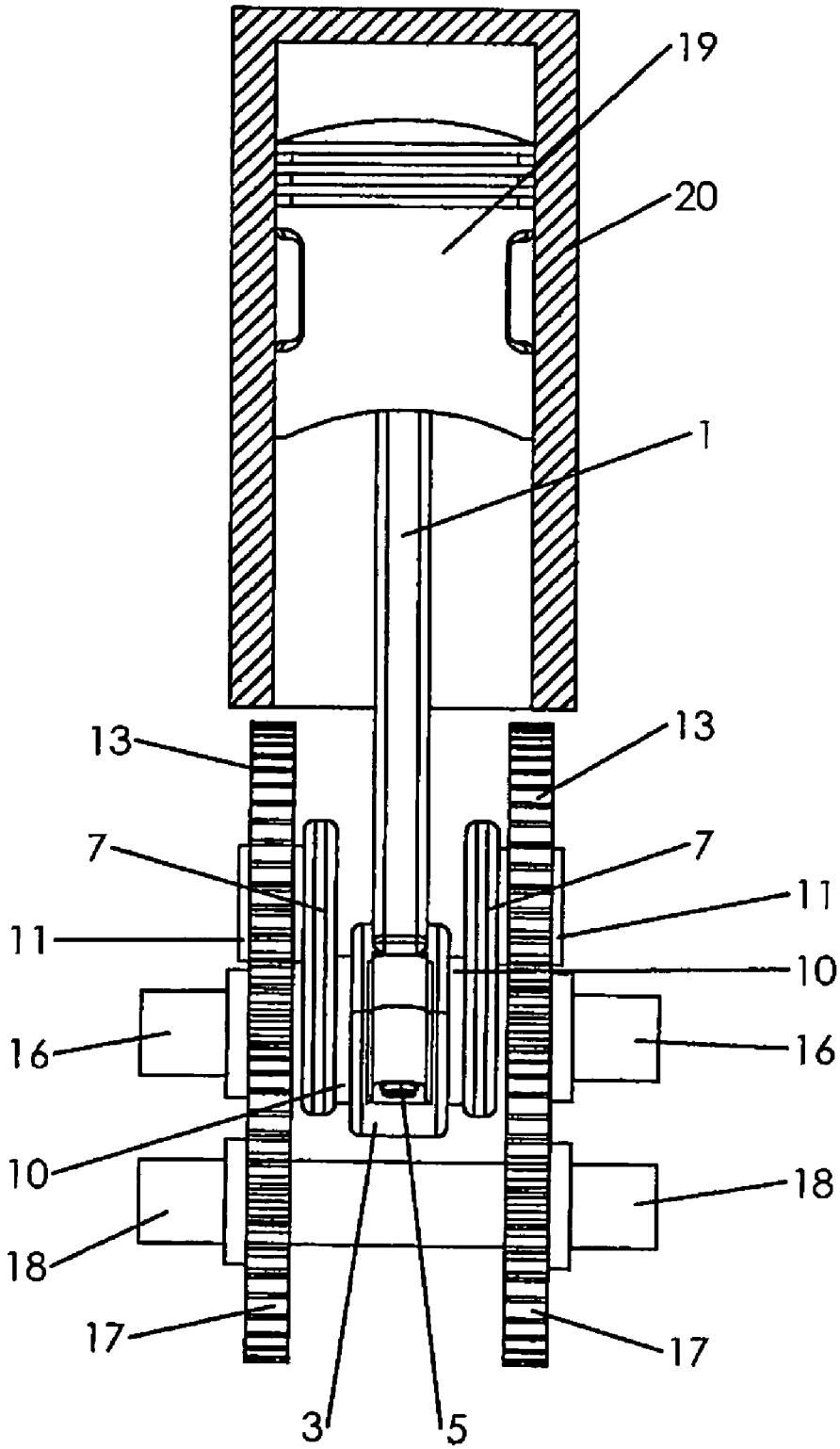
FIG. 8 is a side view of the present invention.

FIG. 8 is a side view of the present invention. This figure shows the first, second and third connecting shafts 10, 11, 16 in relation to one another. It also shows both arms 7 of the yoke assembly in relation to the crank gears 13 and connecting rod 1.

FIGS. 9-16 illustrate the mechanism of the present invention. In these figures, only one crank gear and one drive gear are shown for clarity, although in practice there would be a second crank gear on top of the yoke assembly and a second drive gear on top of the first drive gear.

Figure 10:
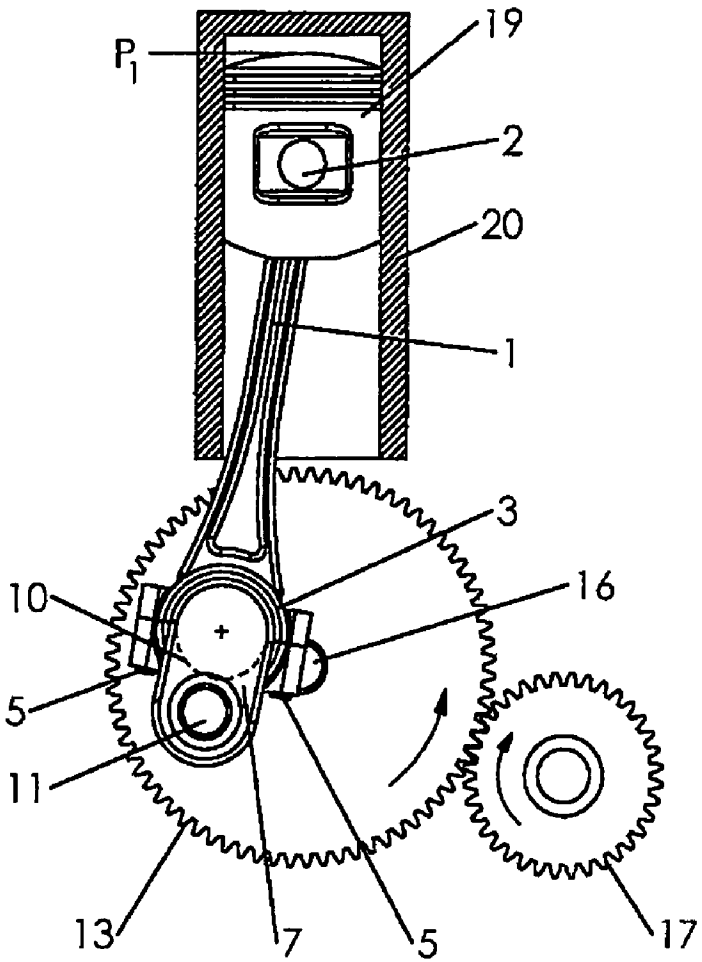
FIG. 10 is a schematic drawing of the present invention in the middle of the intake stroke.
Figure 9:
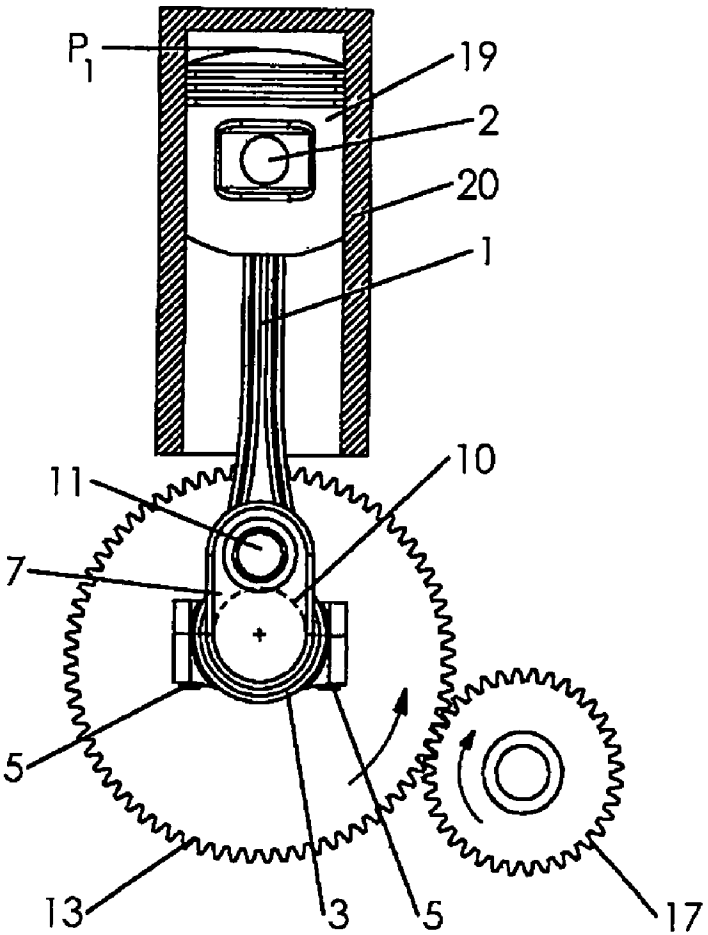
FIG. 9 is a schematic drawing of the present invention at the beginning of the intake stroke.

FIGS. 9-12 show the present invention during the intake and compression strokes. FIG. 9 is a schematic drawing of the present invention at the beginning of the intake stroke. In this position, the piston 19 is at the top of the cylinder 20, the arm 7 of the yoke assembly is vertically aligned with the connecting rod 1, and the second connecting shaft is on top of the first connecting shaft 10. FIG. 10 is a schematic drawing of the present invention in the middle of the intake stroke. In this position, the piston 19 begins its downward movement in the cylinder 20. The crank gear 13 starts to pull the piston 19 down once the first end 2 of the connecting rod 1, first connecting shaft 10 and second connecting shaft 11 form a straight line. The connecting rod 1 and yoke assembly 6 are now at their longest length (measured as the length from the first end 2 of the connecting rod 1 to the second connecting shaft 11). Until this alignment, the crank gear 13 is not pulling the piston 19 down but lengthening the connecting rod 1 and yoke assembly 6. The intake valve (not shown) has opened to allow the fuel/air mixture to enter the cylinder between the top of the piston and the cylinder head (i.e., the space created by the piston moving downward in the cylinder), and the center of the second connecting shaft 11 has swung outward, as shown in FIG. 10.

Figure 12:
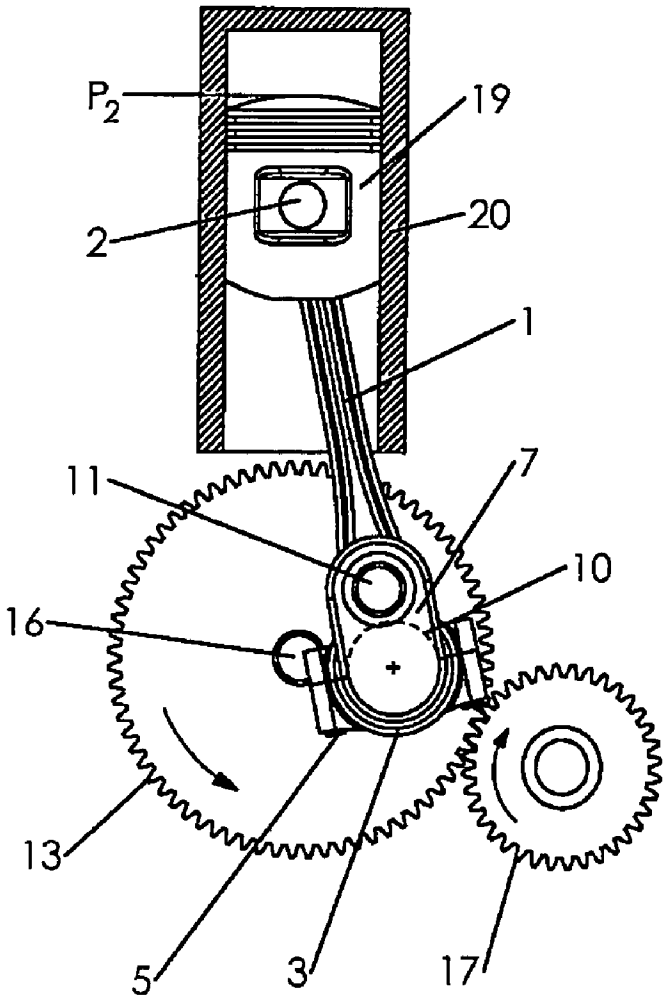
FIG. 12 is a schematic drawing of the present invention in the middle of the compression stroke.
Figure 11:
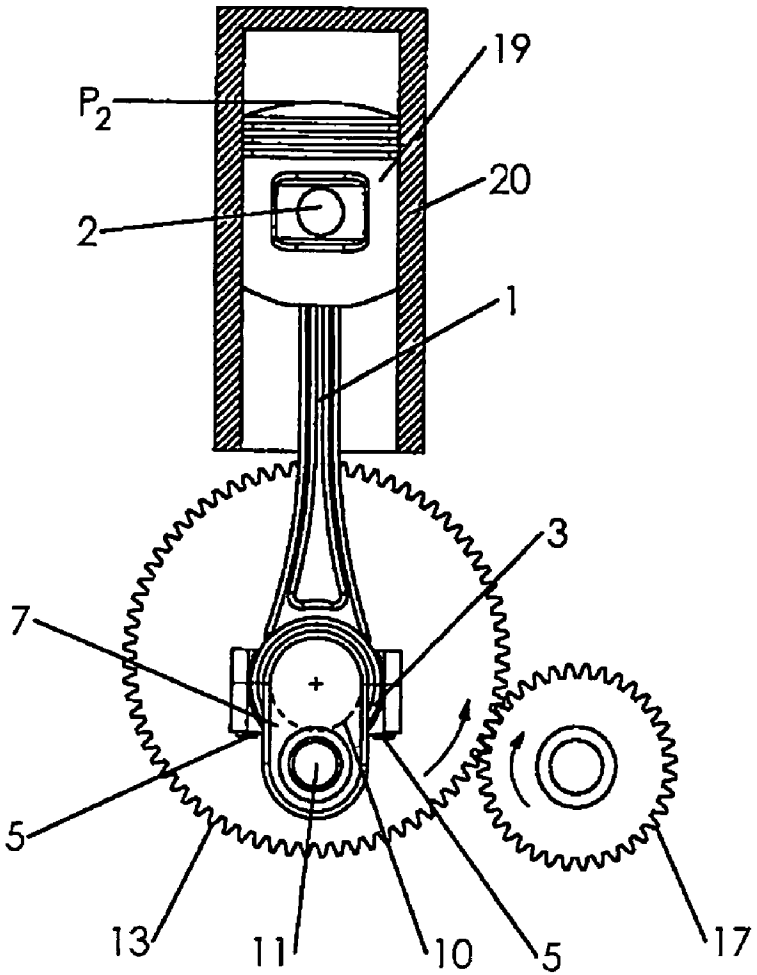
FIG. 11 is a schematic drawing of the present invention at the end of the intake stroke and the beginning of the compression stroke.

FIG. 11 is a schematic drawing of the present invention at the end of the intake stroke and the beginning of the compression stroke. In this position, the piston 19 has moved farther downward, the arm 7 of the yoke assembly is again vertically aligned with the connecting rod 1, and the first connecting shaft 10 is on top of the second connecting shaft 11. At this point, the intake valve closes, and the compression stroke begins. The piston has traveled a distance equal to $2R_c$ minus $2R_y$. As explained below, this distance determines the intake/compression ratio. FIG. 12 is a schematic drawing of the present invention in the middle of the compression stroke. In this position, the connecting rod 1 and the yoke assembly 6 have realigned to their shortest length (i.e., the distance from the first end 2 of the connecting rod 1 to the second connecting shaft 11), and the crank gear can begin to push the piston 19 upward in the cylinder 20.

Figure 14:
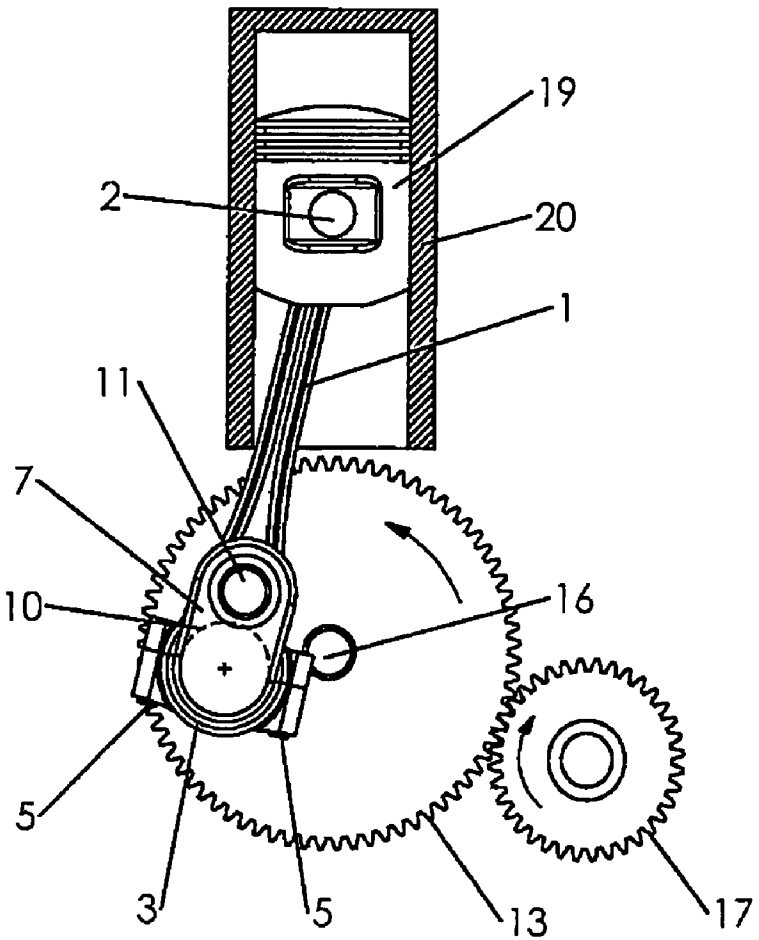
FIG. 14 is a schematic drawing of the present invention in the middle of the power stroke.
Figure 13:
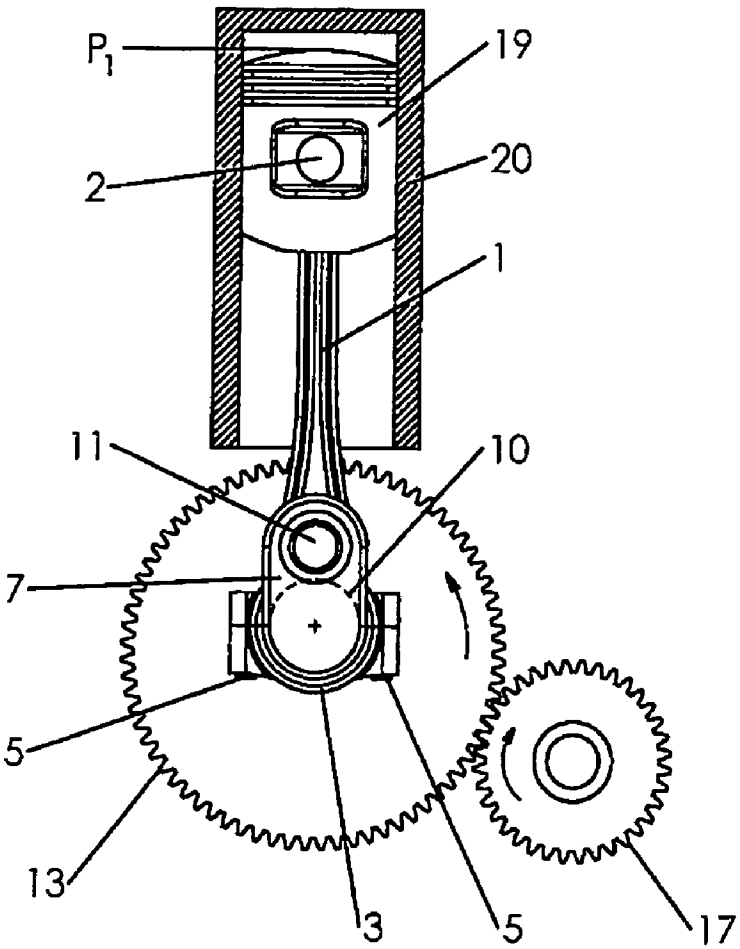
FIG. 13 is a schematic drawing of the present invention at the end of the compression stroke and the beginning of the power stroke.

FIGS. 13-16 show the present invention during the power and exhaust strokes. FIG. 13 is a schematic drawing of the present invention at the end of the compression stroke and the beginning of the power stroke. The position shown in FIG. 13 is the same as the position shown in FIG. 9 (at the start of the intake stroke); however, the fuel/air mixture that entered the cylinder 20 during the intake cycle is now ignited, causing the piston 19 to travel farther downward in the cylinder during the power stroke than it did during the intake stroke. FIG. 14 is a schematic drawing of the present invention in the middle of the power stroke. In this position, the center of the first connecting shaft 10 has swung farther toward the perimeter of the crank gear 13 than it did during the intake stroke (see FIG. 10). Throughout the power and exhaust strokes, the first end 2 of the connecting rod 1 and the yoke assembly 6 remain at their shortest length (measured as the distance between the first end 2 of the connecting rod 1 and the second connecting shaft 11) alignment because of the pressure in the cylinder 20 above the piston 19.

Figure 16:
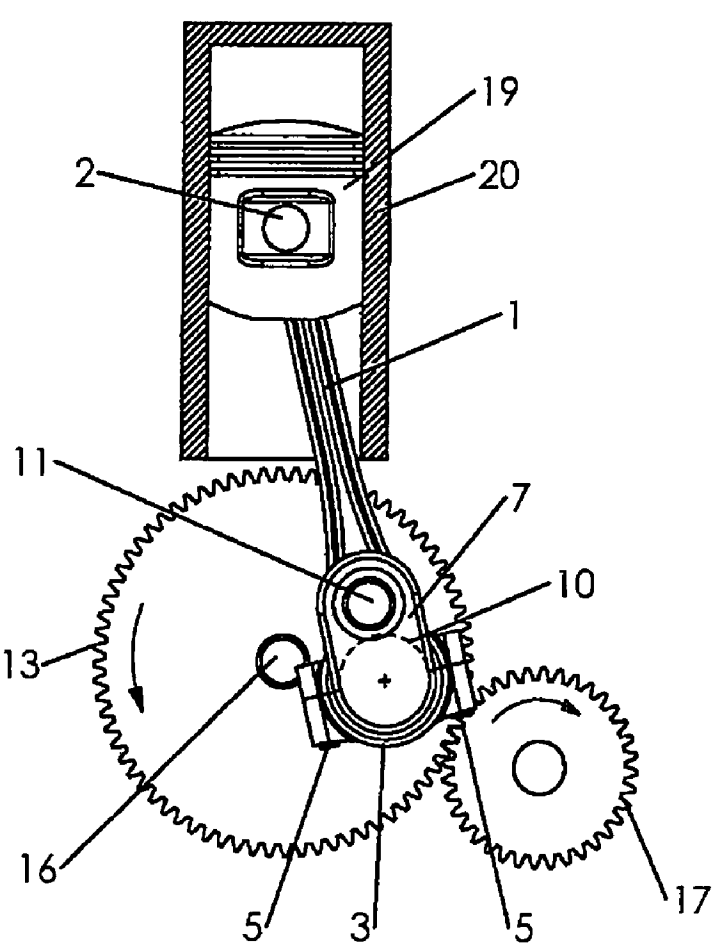
FIG. 16 is a schematic drawing of the present invention in the middle of the exhaust stroke.
Figure 15:
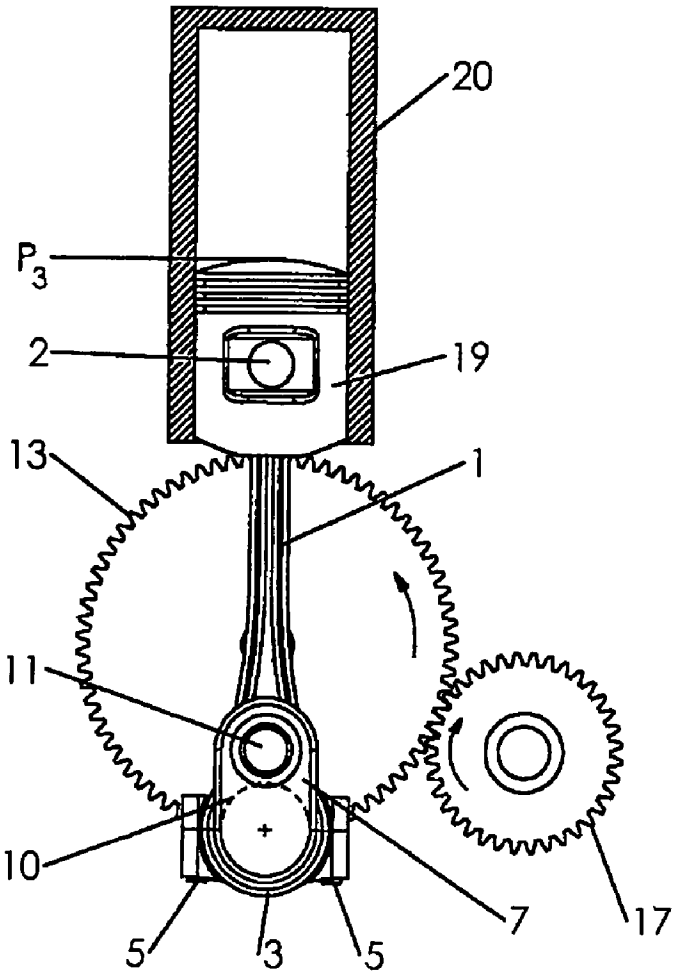
FIG. 15 is a schematic drawing of the present invention at the end of the power stroke and the beginning of the exhaust stroke.

FIG. 15 is a schematic drawing of the present invention at the end of the power stroke and the beginning of the exhaust stroke. In this position, the piston 19 has moved farther downward than it did during the intake stroke (see FIG. 11), and the arm 7 of the yoke assembly is again vertically aligned with the connecting rod 1, although the second connecting shaft 11 is now on top of the first connecting shaft 10. At this point, the exhaust valve opens, and the exhaust stroke begins. The piston has traveled a distance equal to $2R_c$. As explained below, this distance determines the power/exhaust ratio. FIG. 16 is a schematic drawing of the present invention in the middle of the exhaust stroke. In this position, the piston 19 has just started to move upward in the cylinder 20, and the center of the first connecting shaft 10 has again swung outward to maintain the alignment of the connecting rod 1 and yoke assembly 6, as shown in FIG. 16. At the end of the exhaust cycle, the piston is in the same position shown in FIG. 13, and the exhaust valve is closed.

As shown in FIGS. 9-12, the top of the piston 19 moves from position $P_1$ to position $P_2$ during the intake cycle and from position $P_2$ back to position $P_1$ during the compression cycle. As shown in FIG. 13-16, the top of the piston 19 moves from position $P_1$ to position $P_3$ during the power cycle and from position $P_3$ back to position $P_1$ during the exhaust cycle. In this manner, the power stroke is extended relative to the intake stroke, thereby increasing the efficiency of the engine. In a standard engine without the yoke assembly of the present invention, the piston moves the same distance during the intake and power strokes. It is the yoke assembly of the present invention that allows the piston to travel farther downward in the cylinder during the power stroke than during the intake stroke. This result is achieved because the second end 3 of the connecting rod 1 is not fixedly attached to the off-center hole 15 of the crank gear 13 but rather rotatably attached (via the first connecting shaft 10) to the yoke arms 7.

As explained below, the values for $R_y$ and $R_c$ determine the intake/compression and power/exhaust cycle ratios:

$R_c$=distance from center of crank gear to center of off-center hole $R_y$=distance from center of first connecting shaft to center of second connecting shaft $H_o$=headspace above piston at end of compression/exhaust strokes $H_i$=headspace above piston at end of intake stroke $H_p$=headspace above piston at end of power stroke $$\text{Length of intake stroke}=H_i-H_o=S_i=(2\times R_c)-(2\times R_y)$$

$$\text{Length of power stroke}=H_p-H_o=S_p=(2\times R_c)$$

For a 8:1 intake/compression ratio and a 16:1 power/exhaust ratio:

$$R_o=3.0''$$

$$S_p=2\times 3.0''=6.0''$$

$$H_o=H_p-S_p$$

$$H_p=(H_o)\times 16 \Rightarrow S_p=15H_o$$

$$H_o=S_p/15=0.4''$$

$$H_i=(H_o)\times 8=(0.4)\times 8=3.2''=>S_i=H_i-H_o=3.2-0.4=2.8''$$

$$S_i=(2\times R_c)-(2\times R_y)=>R_y=[(2\times R_c)-S_i]/2=[(2\times 3.0)-2.8]/2=6.0-2.8]/2=1.6''$$

Note that $R_y$ must be less than $R_c$ in order for the length of the intake stroke ($S_i$) to have a positive value.

Figure 17:
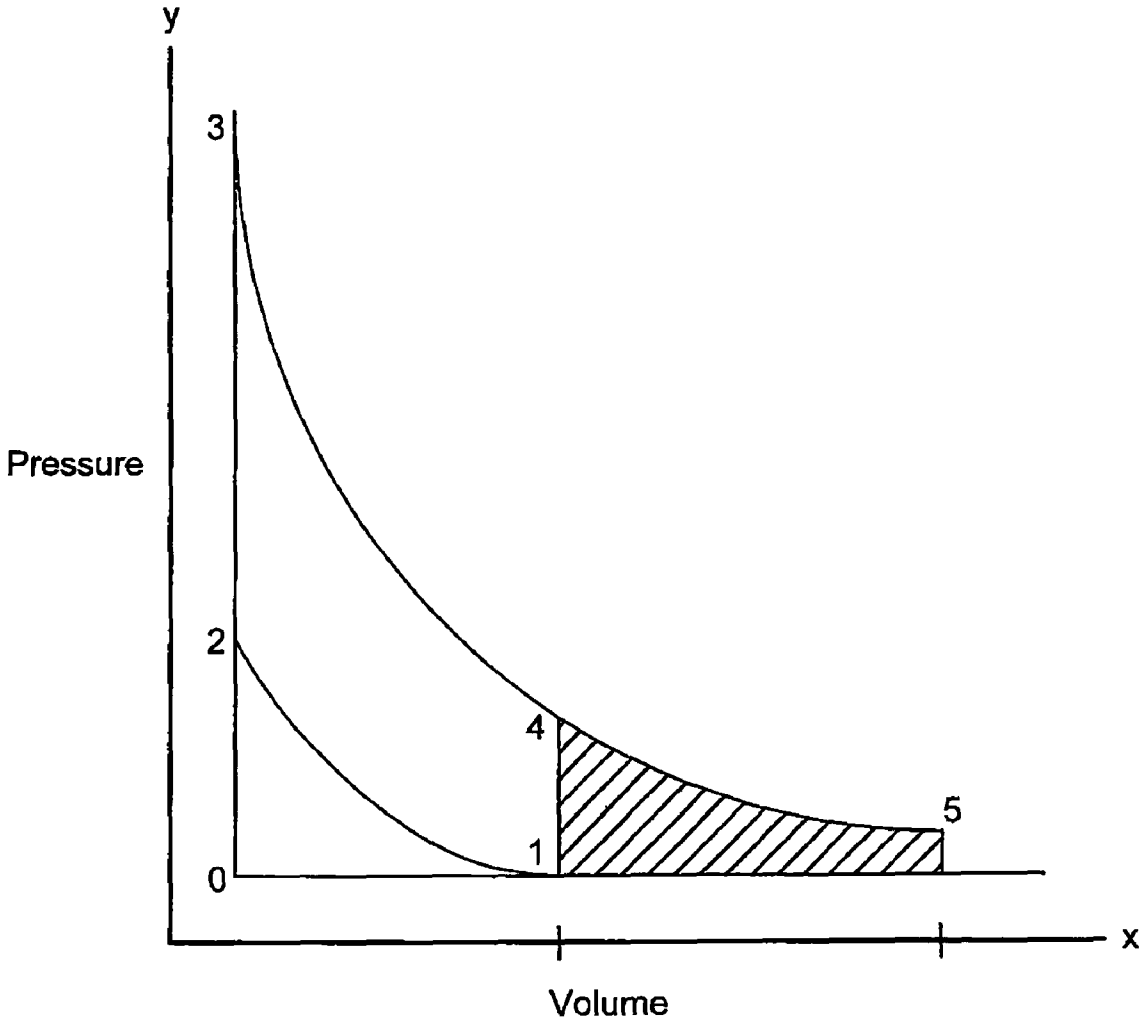
FIG. 17 is a graph of pressure versus volume to illustrate the increased thermodynamic efficiency of the present invention.

FIG. 17 is a graph of pressure versus volume to illustrate the increased thermodynamic efficiency of the present invention. In a traditional four-cycle engine, the volumes associated with all four strokes (intake, compression, power and exhaust) are equal because the piston is connected to a crank shaft by a fixed length connecting rod. The thermodynamic efficiency of this type of engine is a function of the intake-to-compression ratio. An 8:1 compression ratio results in a thermodynamic efficiency of approximately 56%.

The variable length connecting rod of the present invention allows for an 8:1 intake-to-compression ratio and a 16:1 power-to-exhaust ratio. The thermodynamic efficiency of this type of engine is approximately 67%, resulting in a 20% increase in fuel efficiency.

Referring to FIG. 17, the intake cycle is represented by the line that extends from number "0" on the x (volume) axis to number "1" on the x axis. The compression cycle is represented by the line that extends from the number "1" on the x axis to the number "2" on the y (pressure) axis. Ignition of the fuel/air mixture is represented by the line that extends from the number "2" on the y axis to the number "3" on the y axis. The representations of the intake and compression cycles and the fuel ignition in FIG. 17 are the same in a traditional engine as they are in an engine that incorporates the variable length connecting rod of the present invention; the difference is in the power stroke.

The power stroke in a traditional engine is represented by the line that extends from "3" on the y axis to point "4," which has both x and y coordinates (i.e., it has both a positive volume and a positive pressure value). In an engine that incorporates the variable length connecting rod of the present invention, the power stroke is represented by the line that extends from "3" on the y axis to point "5," which has a substantially lower pressure value (and therefore a lower temperature value) as compared to point "3." The significance of this statement is that the present invention releases exhaust gas at a lower pressure and lower temperature than a traditional engine. The energy that is captured and utilized by the present invention—above and beyond a traditional engine—is represented by the hatched area in FIG. 17.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A four-cycle internal combustion engine comprising a variable length connecting rod, two crank gears, and two drive gears;

wherein the connecting rod comprises a first end and a second end;

wherein the first end of the connecting rod is connected to a piston;

wherein the piston is located inside of a cylinder;

wherein the second end of the connecting rod is connected to a yoke assembly;

wherein the yoke assembly comprises two arms, a first connecting shaft, and two second connecting shafts;

wherein the second end of the connecting rod comprises an aperture through which the first connecting shaft extends;

wherein the first connecting shaft connects the second end of the connecting rod to each of the yoke arms;

wherein the second end of the connecting rod and the yoke arms rotate freely about the first connecting shaft;

wherein each crank gear comprises an off-center hole;

wherein the second connecting shafts connect the yoke arms to the off-center hole of each crank gear;

wherein the yoke arms and the crank gear rotate freely about the second connecting shaft;

wherein each crank gear is driven by a drive gear;

wherein the piston travels downward in the cylinder during an intake stroke and a power stroke; and wherein the piston travels farther downward in the cylinder during the power stroke than it does during the intake stroke.

2. The four-cycle internal combustion engine of claim 1, wherein the engine undergoes an intake stroke, a compression stroke, a power stroke and an exhaust stroke;

wherein the piston travels the same distance during the intake stroke as it does during the compression stroke;

wherein the piston travels the same distance during the power stroke as it does during the exhaust stroke;

wherein the engine releases exhaust gas during the exhaust stroke;

wherein the exhaust gas has a temperature and a pressure;

wherein a traditional four-cycle internal combustion engine generates exhaust gas with a temperature and pressure; and wherein the temperature and pressure of the exhaust gas generated by the present invention are lower than the temperature and pressure of the exhaust gas in a traditional four-cycle internal combustion engine.

3. The four-cycle internal combustion engine of claim 2, wherein each crank gear has a center;

wherein each off-center hole in each crank gear has a center;

wherein the first and second connecting shafts each has a center; and wherein during the intake stroke, the piston travels a distance equal to two times the distance from the center of the crank gear to the center of the off-center hole in the crank gear minus two times the distance from the center of the first connecting shaft to the center of the second connecting shafts.

4. The four-cycle internal combustion engine of claim 2, wherein each crank gear has a center;

wherein each off-center hole in each crank gear has a center; and wherein during the power stroke, the piston travels a distance equal to two times the distance from the center of the crank gear to the center of the off-center hole in the crank gear.

5. The four-cycle internal combustion engine of claim 1, wherein each crank gear has a center;

wherein each off-center hole in each crank gear has a center;

wherein the first and second connecting shafts each has a center;

wherein $R_c$ is the distance between the center of the crank gear and the center of the off-center hole;

wherein $R_y$ is the distance between the center of the first connecting shaft and the center of the second connecting shafts;

wherein the engine undergoes an intake stroke, a compression stroke, a power stroke and an exhaust stroke, and each stroke has a beginning and an end;

wherein there is headspace in the cylinder above the piston at the end of the intake, compression, power and exhaust strokes;

wherein $H_o$ is the amount of headspace above the piston at the end of the compression and exhaust strokes;

wherein $H_i$ is the amount of headspace above the piston at the end of the intake stroke;

wherein $H_p$ is the amount of headspace above the piston at the end of the power stroke;

wherein the intake stroke and power stroke each has a length;

wherein the length of the intake stroke is equal to $H_i-H_o$ or $(2\times R_c)-(2\times R_y)$;

wherein the length of the power stroke is equal to $H_p-H_o$ or $(2\times R_c)$; and wherein $R_y$ is less than $R_c$.

* * * * *